US008237076B2

(12) United States Patent
Sato et al.

(10) Patent No.: US 8,237,076 B2
(45) Date of Patent: Aug. 7, 2012

(54) VACUUM SWITCH

(75) Inventors: Takashi Sato, Mito (JP); Kenji Tsuchiya, Hitachi (JP); Ayumu Morita, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 335 days.

(21) Appl. No.: 12/534,306

(22) Filed: Aug. 3, 2009

(65) Prior Publication Data

US 2010/0038343 A1 Feb. 18, 2010

(30) Foreign Application Priority Data

Aug. 12, 2008 (JP) ..... 2008-207557

(51) Int. Cl.
*H01H 33/66* (2006.01)

(52) U.S. Cl. ..... 218/153; 218/119

(58) Field of Classification Search ..... 218/2, 7, 218/10, 14, 152–154
See application file for complete search history.

(56) References Cited

U.S. PATENT DOCUMENTS

| | | | | |
|---|---|---|---|---|
| 7,880,111 | B2 * | 2/2011 | Inoue et al. | 218/136 |
| 2007/0228014 | A1 | 10/2007 | Tsuchiya et al. | |
| 2009/0134125 | A1 | 5/2009 | Inoue et al. | |

FOREIGN PATENT DOCUMENTS

| | | |
|---|---|---|
| EP | 1 343 233 A2 | 9/2003 |
| EP | 1 739 802 A1 | 1/2007 |
| JP | 2002-152930 | 5/2002 |
| JP | 2003-47113 | 2/2003 |
| JP | 2003-331700 | 11/2003 |
| JP | 2004-056841 | 2/2004 |
| JP | 2005/197127 | 7/2005 |
| JP | 2006-238522 | 9/2006 |
| JP | 2007-014086 | 1/2007 |
| JP | 2007-095316 | 4/2007 |
| WO | WO 2007/116661 | 10/2007 |

OTHER PUBLICATIONS

Japanese Office Action in JP 2008-207557 mailed Oct. 26, 2010 (with partial English translation).
Search Report in European Patent Application No. 09010136.1-2214 dated Nov. 26, 2009.
Chinese Office Action mailed Jul. 20, 2011 in corresponding Chinese Patent Application Serial No. 2009101653983.
Tawainese Office Action dated Mar. 8, 2012, issued in corresponding Tawainese Application No. 098121820 with partial English language translation.

* cited by examiner

*Primary Examiner* — Amy Cohen Johnson
*Assistant Examiner* — Marina Fishman
(74) *Attorney, Agent, or Firm* — Brundidge & Stanger, P.C.

(57) ABSTRACT

A vacuum switch means a unit switch section comprising a pair of vacuum main circuit switches, an earth switch, operating rods for operating movable conductors of the main circuit vacuum switch and earth switch, and a molding case covering the main circuit switch, earth switch and the operating rods, wherein the operating rods are connectable with an operating mechanism, and the fixed conductors of the main circuit switch and earth switch are connected with bushing conductors. The main circuit vacuum switches are disposed in separate vacuum chambers. The movable conductors of the main circuit switches and electrically connected to each other via a transition conductor, and the movable conductors are operated synchronously by means of a transition rod connected to the transition rod.

20 Claims, 9 Drawing Sheets

VACUUM SWITCH

CLAIM OF PRIORITY

The present application claims priority from Japanese Patent Application serial No. 2008-207557, filed on Aug. 12, 2008, the content of which is hereby incorporated by reference into this application.

FIELD OF THE INVENTION

The present invention relates to a vacuum switch and a vacuum switchgear, and more particularly to a unit vacuum switch having an improved switching structure, and a switchgear employing the unit vacuum switch. In the present invention, the vacuum switch means a unit vacuum switch comprising a main circuit vacuum switch, an earth switch, operating rods for operating movable conductors of the main circuit switch and the earth switch, and a molding case covering vacuum chambers of the main circuit switch and the earth switch and the operating rods for the movable conductors of the main circuit vacuum switch, wherein the operating rods are connectable with an operating mechanism, and the fixed conductors of the main circuit vacuum switch and the earth switch are connected with bushing conductors. The vacuum switchgear is constituted by at least one of the vacuum switch, an operating mechanism for the main circuit vacuum switch and the earth switch, a cable room and a panel room. The panel room accommodates protection relays, voltage transformers, etc. The cable room may accommodate a current transformer. The earth switch should be a vacuum switch.

BACKGROUND OF THE INVENTION

Vacuum switchgears utilized vacuum insulation with high insulation capability wherein switches are held in vacuum to thereby shorten insulation distance so that small sized switchgears are realized. Conventional vacuum switchgears are disclosed in patent document No. 1, for instance.

The patent document No. 1 discloses a vacuum switchgear comprising a main circuit switch, which comprises two pairs of main contacts for performing three positions of turn-on, breaking and disconnection, main circuit conductors for electrically connecting the two pairs of the main contacts, insulating rods for electrically insulatedly connecting the main circuit conductors with operators for the main circuit switches, and earth switches electrically connected to the main circuit switches disposed in vacuum chambers different from vacuum chambers for the main circuit switches, the main switch being accommodated in the vacuum chamber, which is molded with insulating resin coated with a conductive layer for earthing the vacuum chamber.

Patent document No. 1; JPA2007-14086

SUMMARY OF THE INVENTION

Since the main contacts for performing the three positions of turn-on, breaking and disconnection are accommodated in a single vacuum chamber, a problem may be caused because all the vacuum switches accommodated in the single vacuum chamber of the unit switch do not perform the operation of breaking and disconnection, if one of the vacuum chambers of the switches breaks its vacuum. That is, reliability of the vacuum switchgear is not sufficiently high.

Since the two main circuit contacts, main circuit conductors for connecting the main contacts and the insulating rods are accommodated in the single vacuum chamber, the structure of the vacuum chamber must be complicated so as to protect the vacuum chamber and to perform operations of the contacts. If the structure of the vacuum chamber is complicated, a production cost of the unit switches and switchgears will be increased, and a number of the vacuum chambers must be placed in a vacuum heating furnace for processing the vacuum chambers, which also increases a production cost. Thus, the conventional vacuum switch chamber were not optimum for the mass production.

The present invention aims at removing the above-mentioned problems. That is, the present invention provides a unit vacuum switch, which has a simplified vacuum chamber structure and can be manufactured at a relatively low cost. The present invention provides a unit switch with high reliability. The unit vacuum switch and the switchgear of the present invention has remarkably increased reliability, because even if one of vacuum chambers of the main circuit switches is broken or vacuum leakage of the vacuum chamber takes place, the performance of the unit vacuum switch and the switchgear is not lost so that the reliability of the unit vacuum switch and the switchgear will be remarkably increased.

The unit vacuum switch (100) of the present invention comprises a pair of a vacuum switches each comprising a vacuum chamber (1A, 1B) and movable contact (5A, 5B) connected to a conductor (17A, 17B) and a fixed contact (9A, 9B) connected to a conductor (18A, 18B), the pair of the movable and fixed contacts being disposed in each of the vacuum chambers (1A, 1B), an earth switch having a pair of a movable contact (31) and a fixed contact (31'), disposed separately in another vacuum chamber (40), a transition conductor (25) connecting between the electrodes (17A, 17B) of the movable contact of the vacuum switches outside of the vacuum chambers, a transition operating rod (26) connected to an operating rod (16) for synchronously operate the movable electrodes (17A, 17B), and an insulating molding casing (22) covering the vacuum chambers 1A, 1B of the vacuum switches and the earth switch and having a conductive layer (X) on its surface for earthing.

According to the present invention, the vacuum chambers for accommodating the movable contact connected to the movable conductor and the fixed contact connected to the fixed conductor have basically almost the identical, simple structure, compared to that of the conventional one, disclosed in the patent document No. 1, for instance. Therefore, the production of the vacuum chambers is very easy and cost saving. Since the two vacuum switches constitute one two-point breaking vacuum switch. Since the switches are accommodated in separated vacuum chambers, the reliability of the vacuum switchgear will be remarkably increased even if one of the vacuum chamber is broken or a vacuum leak takes place.

DETAILED DESCRIPTION OF PREFERRED EMBODIMENTS

Figure 1:
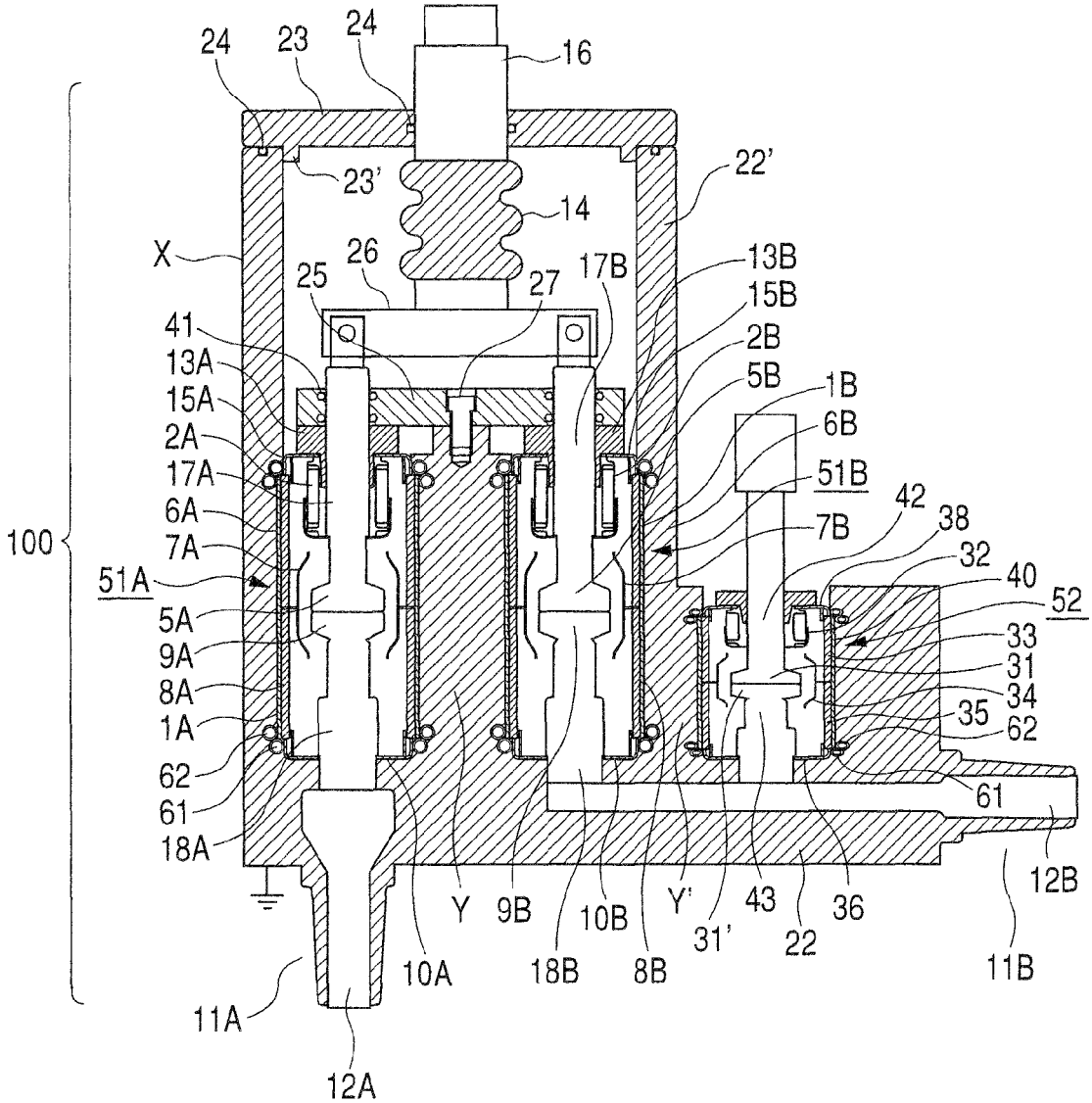
FIG. 1 is a cross sectional view of a unit vacuum switch of the first embodiment of the present invention.

The embodiments of the present invention will be explained in detail by reference to drawings. Reference numerals of the drawings are as follows.

REFERENCE NUMERALS

1A, 1B; vacuum chamber, 2A, 2B, 32; bellows, 5A, 5B, 31; movable contact, 6A, 6B; upper ceramic insulating cylinder, 7A, 7B; arc shield, 8A, 8B; lower ceramic insulating cylinder, 9A, 9B, 31; fixed contact, 10A, 10B, 36; lower seal ring, 11A, 11B; bushing, 12A, 12B; bushing conductor, 12C; load cable or high voltage cable, 13A, 13B; insulating guide, 14; operating rod, 15A, 15B, 38, upper seal ring, 16; operating rod, 17A, 17B, 42; movable conductor, 18A, 18B, 43; fixed conductor, 22; earthed molding, 22'; cylinder portion of the molding 22, 23; molded lid, 23'; projection, 24; seal, 25; transition conductor, 26; transition operating rod, 27; bolt, 31; movable contact for the earth switch, 31'; fixed contact for the earth switch, 33; upper ceramic cylinder, 35; lower ceramic cylinder, 40; vacuum chamber for earth switch, 41; spring contact, 48; rubber diaphragm, 50; electro-conductive rubber bellows, 51A, 51B; main circuit vacuum switch (breaking/disconnection section), 52; earth switch, 60; solid insulated busbar, 61, 62; coil spring, 65; operator room, 66; cable room, 67; panel room, 69; current transformer (CT), 70; switch unit room, 90; electro-magnetic repulsion force, 100; unit vacuum switch, X; electro-conductive layer, Y; solid-insulation portion between the vacuum chambers of the switches 51A, 51B, Y'; solid-insulation portion between the vacuum chamber of the switch 51B and the earth switch 52.

First Embodiment

Figure 2:
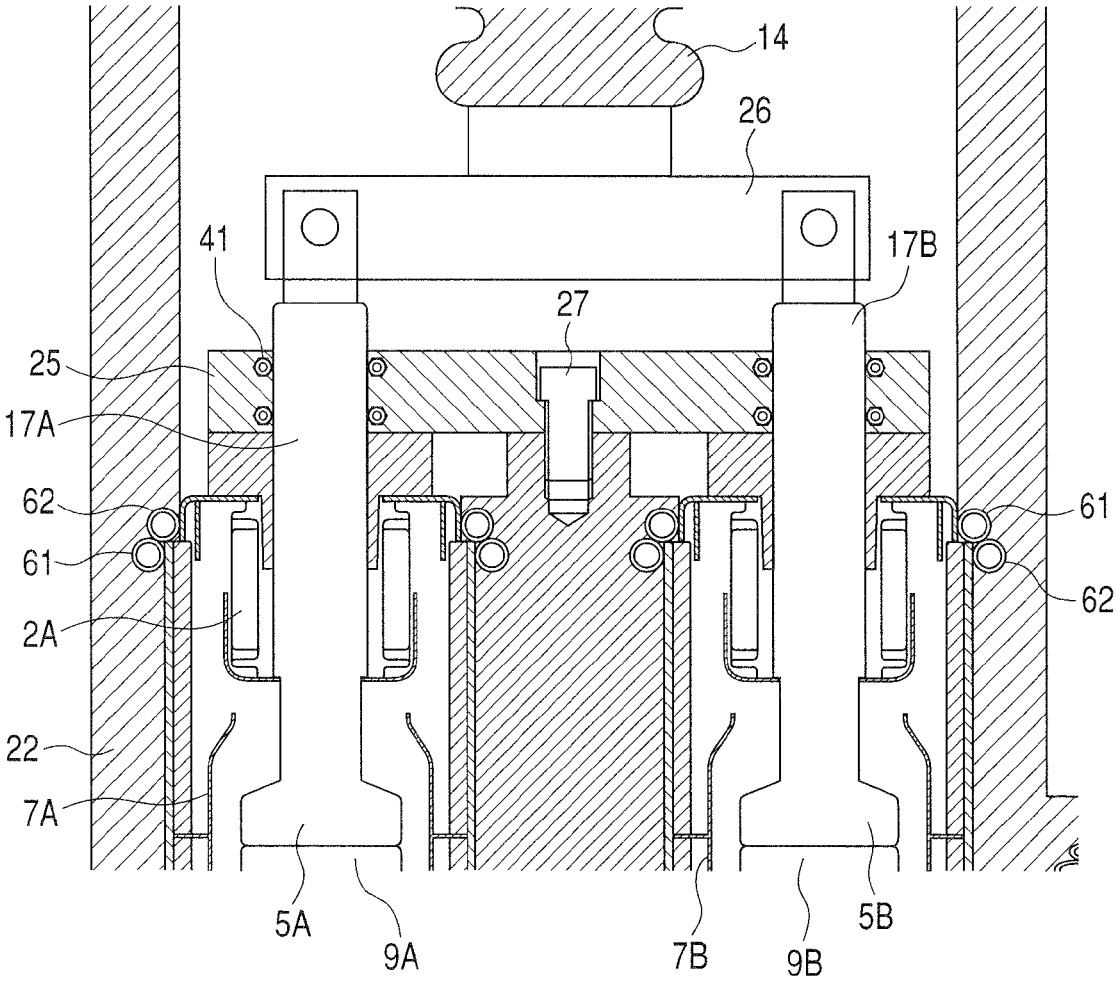
FIG. 2 shows an enlarged cross sectional view of the unit vacuum switch section shown in FIG. 1.
Figure 5:
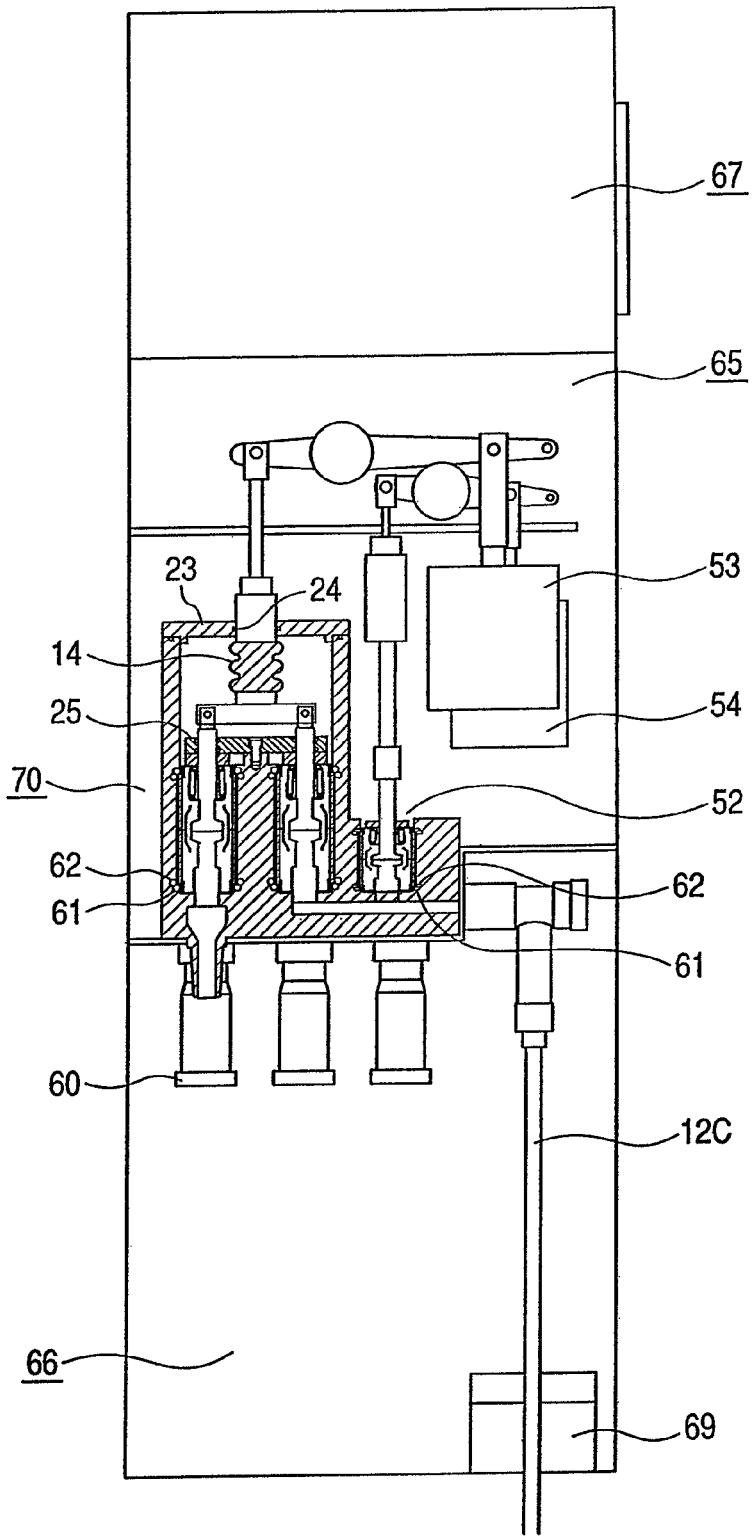
FIG. 5 is a partially cross sectional view of the switchgear that employed the unit vacuum switch of the first embodiment shown in FIG. 1.

The first embodiment of a unit vacuum switch of the present invention will be explained by reference to FIGS. 1, 2 and 5. In FIGS. 1, 2, only one phase of three phases is shown. The other two phases are constituted in the same way as in the following. As is shown in FIG. 5, the unit vacuum switchgear comprises the unit vacuum switch 100 comprising two vacuum switches (51A, 51B) each accommodated in separated vacuum chambers, an earth switch (52) and an earthed molding (22).

The switches 51A, 51B as a circuit breaker and a disconnector will be explained. Each of the vacuum switches 51A, 51B is constituted by a cylindrical vacuum chamber 1A, 1B, which comprises an upper insulating ceramic cylinder 6A, 6B, a lower insulating ceramic cylinder 8A, 8B, an upper metallic seal ring 15A, 15B, a lower metallic seal ring 10A, 10B for establishing vacuum, a fixed contact 9A, 9B, a movable contact 5A, 5B opposed to the fixed contact, the fixed contacts connected to fixed conductors 18A, 18B and movable contacts connected to movable conductors 17A, 17B, an arc shield 7A, 7B and bellows 2A, 2B being disposed in the vacuum chamber 1A, 1B.

One end of the fixed electrode 9A, 9B is connected to the fixed conductors 18A, 18B that penetrates through lower seal ring 10A, 10B, and one end of the movable contact 5A, 5B is connected to the movable conductor 17A, 17B that penetrates through the upper seal ring 15A, 15B. The contact 5A, 5B and the movable conductor 17A, 17B constitute a movable conductor side. The contacts 9A, 9B and the fixed conductors 18A, 18B constitute a fixed conductor side.

The fixed electrode 9A, 9B and the movable contact 5A, 5B are surrounded by the arc shield 7A, 7B fastened between the upper ceramic cylinder 6A, 6B and the lower ceramic cylinder 8A, 8B. Since the movable conductor 17A, 17B is operated by an operator, which will be explained later, the movable conductor 17A, 17B and the upper ceramic cylinder 6A, 6B are sealed with the bellows 2A, 2B to secure vacuum in the vacuum chamber. A coil spring 61, 62 is disposed at a step portion between the ceramic insulating cylinder and the seal ring to cover corners of the seal ring and the ceramic cylinder.

The fixed conductor 18A is connected to a bushing conductor 12A at a position below the vacuum chamber 1A, and the movable conductors 17A, 17B are connected electrically connected via the transition conductor 25. As shown in FIGS. 1 and 2, the transition conductor 25 is pressed towards the upper seal ring 15A, 15B via an insulating guide 13A, 13B and fixed to the molding 22 via a bolt 27. Spring contacts 41, which work as a sliding contact, are disposed between the transition conductor 25 and the movable conductor 17A, 17B so as to secure a slidable contact therebetween. The fixed conductor 18B is connected to the bushing conductor 12B, which is to be connected to a high voltage cable 12C.

The transition conductor 25 may be stiff or flexible. That is, the transition conductor may be a flexible conductor or a non-flexible conductor. Anyway, the transition conductor should preferably be fastened to the molding 22 to perform stable current flow between the movable conductor and to resist the electro-magnetic repulsion force.

The ends of the movable conductors 17A, 17B, which are opposite to connection with the movable contacts, are connected to a transition operating rod 26, which should be stiff so as to operate the movable conductors 17A, 17B synchronously. The transition operating rod 26 is connected with insulating operating rod 14 at the center thereof, and the operating rod 14 is connected to an operating rod 16.

The space above the vacuum chambers 1A, 1B surrounded by the molding 22 and a molding lid 23 is filled with insulating gas such as dry air, SF6 gas, nitrogen gas, etc. The insulating rod 14 has such a length that a sufficient insulation distance is secured between the molding and the transition conductor.

The earth switch 52 will be explained. The earth switch 52 is constituted by a vacuum chamber 40, which comprises an upper ceramic cylinder 33, a lower ceramic cylinder 35, a lower seal ring 36 for air-tightly sealing a lower part of the lower ceramic cylinder 35, an upper seal ring 38 for air-tightly sealing an upper part of the upper cylinder 33, a movable contact 31 connected to a movable conductor 42, a fixed contact 31' connected to a fixed conductor 43, a bellows 32 and a shield 34. The fixed conductor penetrating through the lower seal ring 36 is connected to the bushing conductor 12B. The movable conductor 42 penetrating through the upper seal ring 38 is connected to an operator 54 via an insulator (not shown) as shown in FIG. 5. In order to operate the movable conductor 42 in vacuum, the bellows 32 is fixed to the movable conductor and to the upper seal ring 38. On end of the fixed conductor 43 is connected to the bushing conductor 12B so that the fixed conductor 43 is in the same potential as the main circuit. On the other hand, one end of the movable conductor 42 is connected to the operation mechanism 54 via an insulator.

The switches 51A, 51B, earth switch 52, bushing conductor 12A, 12B are integrally molded with a thermosetting insulating resin such as epoxy resin. That is, the switches and conductors are covered with solid insulation. The molding 22 has a conductive layer X on its entire surface of earthed molding 22. A solid insulation area Y between the switches 51A, 51B is filled with the solid insulation, which is essential for securing safety of the unit vacuum switch. The solid insulation covers the switches in the axial direction over the entire length of the axes of the unit switch and the operating rod at the movable conductor side. The space above the switches 51A, 51B is gastightly closed with the molded lid 23, which is made of insulating material and has a conductive layer on the outer face in order to secure gas-tightness, seals 24 are provided to the molded lid and the molding 22. The molded lid 23 has a projection 23' in the inner surface thereof to fit it in the molding 22. The molding 22 is integrally molded and is constituted by a cylindrical portion 22' covering the switches 51A, 51B, the operating rod and a portion covering the earth switch and bushing conductor 12B.

The operating rod 16 penetrates though the molded lid 23 into the space where the operating rod 16 is connected to the operating rod 14.

A whole structure of the unit vacuum switch will be explained. One end of the bushing 11A formed by molding the bushing conductor 12A with the resin 22 protrudes to a cable room 66 below a switch unit room 65 for accommodating the unit vacuum switches 100, and is connected to a bus bar via bushing conductor 12A.

The bushing conductor 12B and the bushing 11B formed by molding the bushing conductor with resin 22 are connected with a load cable 12C in the cable room 66. A current transformer 69 is disposed at the lower part of the cable room.

An upper part of the switch unit room 65 is a panel room 67, which accommodates protection relays, voltage transformers, etc.

Performance of opening, closing and disconnection will be explained. When the movable contacts 5A, 5B contact with the fixed contacts 9A, 9B, the main circuit is in a closed state. When the operator 53 works in the closed state, the operating rod 16 lifts the transition operating rod 26 thereby to move the movable contacts 5A, 5B connected to the movable conductors 17A, 17B synchronously upward to separate from the fixed contacts by means of the operating rod 16 thereby to interrupt current. Though the transition conductor 25 is fixed by the bolt 27 to the molding 22.

The movable conductors 17A, 17B can move because of the spring contacts 41 that work as a sliding contact, keeping current conduction during operation of the movable conductors.

In case of disconnection operation, the operator mechanism 53 moves, the movable contacts 5A, 5B connected to the movable conductors 17A, 17B to make the movable contacts move upward to a position of disconnection from the breaking position. The movable conductors 17A, 17B can move even if the transition conductor 25 is fixed because of the presence of the spring contacts 41.

Figure 9:
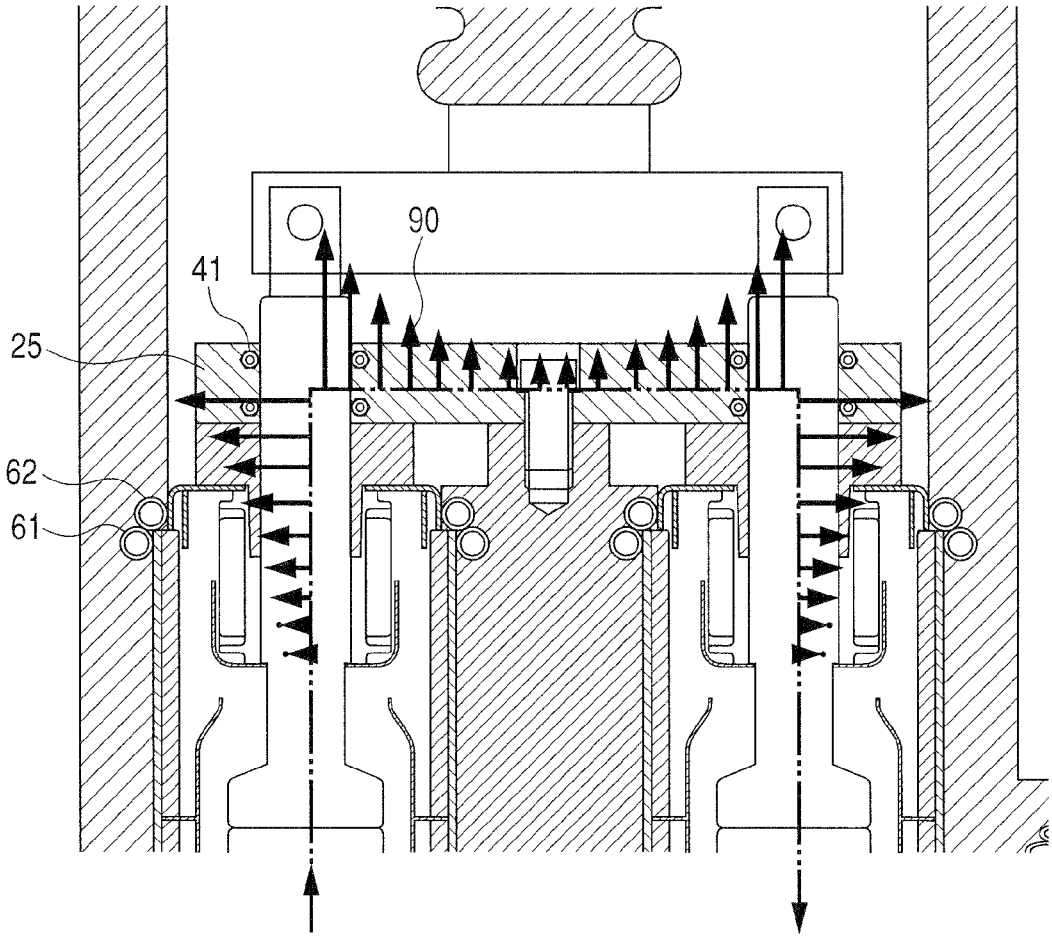
FIG. 9 shows electro-magnetic repulsion force from the movable conductor and the transition conductor.

Electromagnetic repulsion force that generates in the transition conductor and the movable conductor will be explained by reference to FIG. 9. When current flows in each conductor of the main circuit, the electro-magnetic repulsion force is induced. At the time of current conduction, current from the bus bar side flows through the movable conductors 17A, 17B and the transition conductor 25. The current generates magnetic field around the movable conductors 17A, 17B and the transition conductor 25, and a magnetic repulsion force from the magnetic field is applied as shown by arrows 90 in FIG. 9.

In this embodiment, since a pair of the fixed conductor 9A and movable conductors 5A and another pair of the fixed conductor 9B and the movable conductor 5B are accommodated in separate vacuum chambers 1A, 1B, reliability of the unit vacuum switch is improved even if one of the vacuum chambers breaks leaks vacuum. Since the one vacuum chamber has a simple pair of movable conductor and fixed conductor, the structure of the vacuum chamber is very simplified. On the other hand, the structure of the vacuum chamber disclosed in patent document No. 1 is very complicated because the vacuum chambers for two vacuum switches are communicated. Accordingly, this vacuum chamber is less productive and has a high cost. On the other hand, since the structure of the vacuum chamber of the embodiment is similar to that of conventional vacuum valves and very simple, it is very productive and its production cost will be remarkably low.

Since the shape of the vacuum chamber in this embodiment is cylindrical, it is possible to increase a packing factor of the vacuum chamber in a vacuum furnace for processing the vacuum chambers. Therefore, a large number of vacuum chambers can be processed at one time to lower the production cost.

Further, since the shape of the vacuum chamber is same, only one mold for shaping the vacuum chamber is needed to reduce a production cost.

In this embodiment, since gas-tightness of the space (gas insulated area) above the vacuum switches (51A, 51B) is secured by seals 24, the operation rod 16 may be operated, keeping gas-tightness.

Since the two coil springs connected to each other are disposed at the step portions of the connecting portions between the ceramic insulating cylinders and the seal ring to cover the corner of the ceramic cylinders, concentration of electric field at the connecting portion of the ceramic cylinder with the seal ring will be alleviated.

In this embodiment, the transition conductor 25, which is in the potential of the system, is fixed to the molding 22 by means of the bolt 27. Therefore, separation of the transition conductor 25 from the molding 22 can be prevented at the time of current conduction during which a strong electromagnetic repulsion force is induced as shown in FIG. 9. In this embodiment, the transition conductor should preferably be a stiff member. Therefore, the operation mechanism 53 for holding the closed position need not bear the electro-magnetic repulsion force, and the operation mechanism 53 should have a very small holding power. Thus, the operation mechanism can be made small sized.

In addition, since the holding power for closing operation and current conduction state is lowered, electro-magnets of the operation mechanism can be downsized. When the magnets are downsized, a moving weight will be lowered so that energy needed for the operation mechanism 53 will be lowered not only at the time of closing, but also at the time of circuit breaking. As a result, the operation mechanism 53 can be also downsized.

Since the spring contacts 41 that work as the sliding contact are disposed at the contact portion of the movable conductor 17A, 17B with the transition conductor, the movable conductors 17A, 17B can move to perform current conduction, interruption, and disconnection, despite that the transition conductor 25 is fixed to the molding 22. The transition conductor may be fixed by any means that sufficiently fixes the transition conductor to the molding. Therefore, the operating mechanism 53 needs a small power for operating the movable conductors 17A, 17B.

The movable conductors 17A, 17B and fixed conductors 18A, 18B can be unified respectively, instead of combining the movable conductors and the fixed conductors as shown in the embodiment.

Second Embodiment

Figure 3:
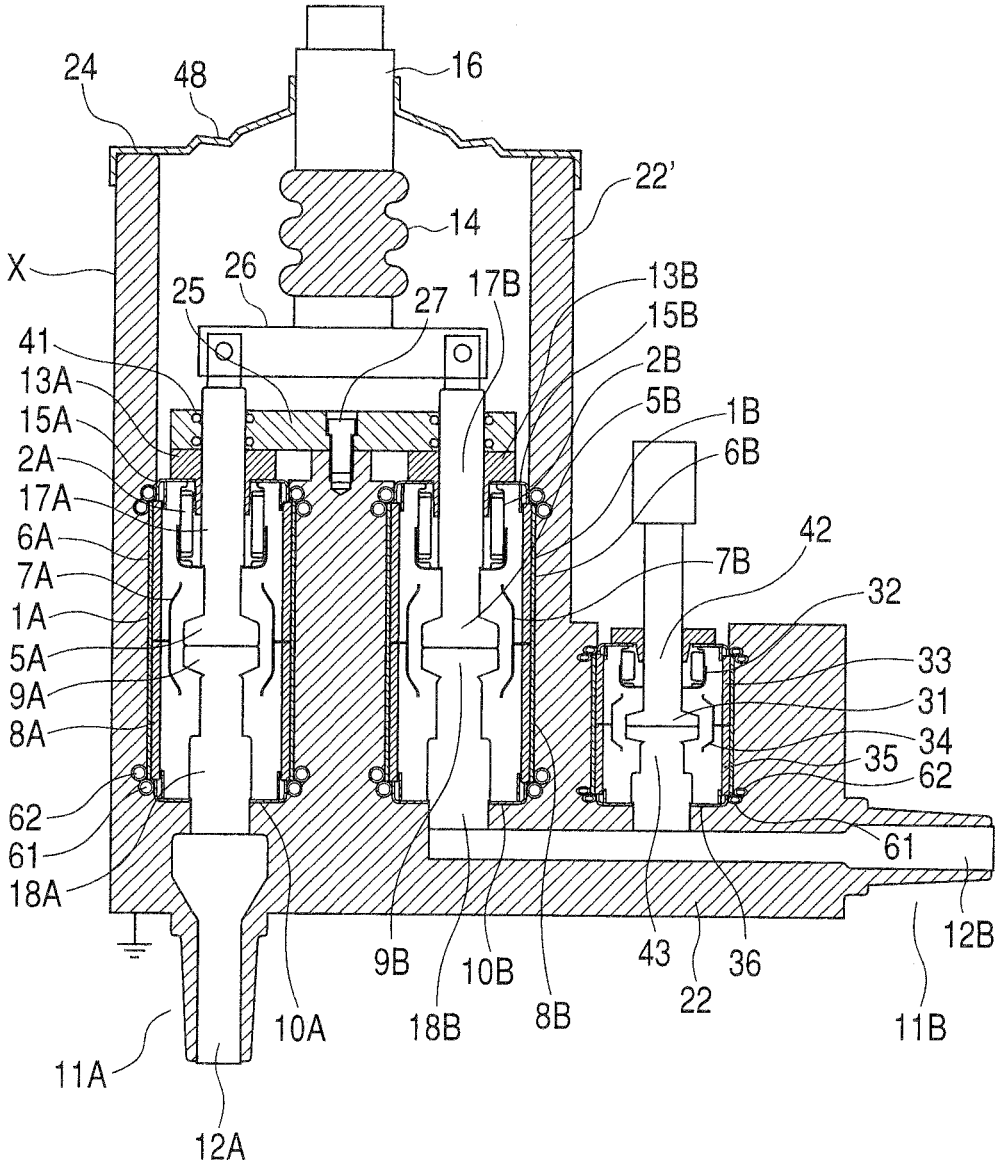
FIG. 3 is a cross sectional view of a unit vacuum switch of the second embodiment.

The second embodiment is explained by reference to FIGS. 3 and 6. In the first embodiment, the space above the main circuit switches is gas-tightly closed with the molded lid 23 and seals 24. In the second embodiment, the gas insulated space is gas-tightly closed with a flexible member such as an electrically conductive rubber diaphragm 48 one end of which is fitted to the periphery of the cylindrical portion 22' of the molding 22, and the other end is fitted to the periphery of the operating rod 16. Other structures are the same as in the first embodiments.

Since the rubber diaphragm 48 is flexible, it follows the movement of the operating rod 16, while keeping gas-tight. Since the rubber diaphragm 48 is electrically conductive, and since it contacts with the earthed molding 22, the potential of the rubber diaphragm 48 is also in the earthed potential, which is safe to workers or operators for maintenance or inspection.

Third Embodiment

Figure 4:
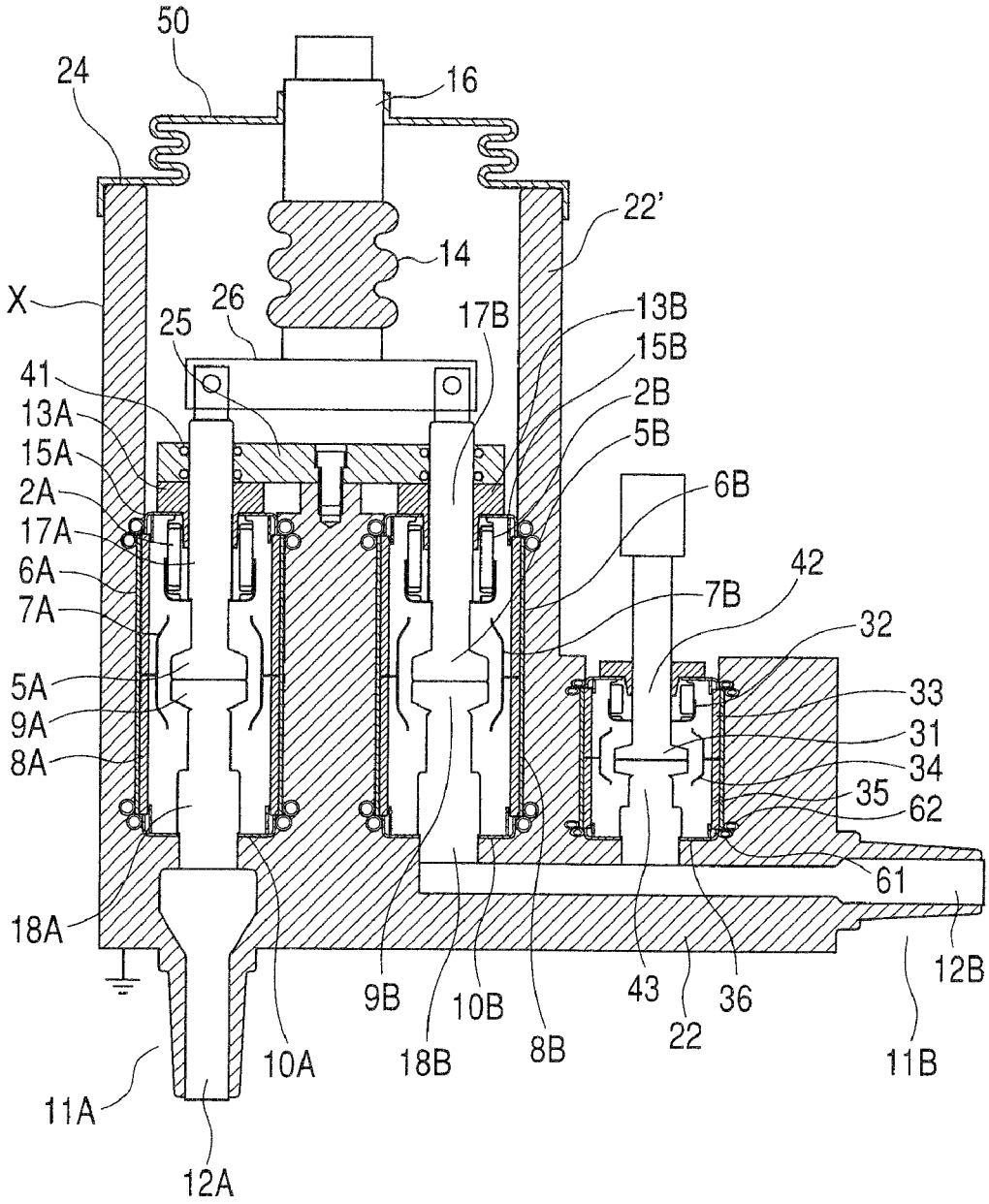
FIG. 4 is a cross sectional view of a unit vacuum switch of the third embodiment.

The third embodiment will be explained by reference to FIGS. 4 and 7. In the second embodiment, the gas insulated space above the main circuit switches is closed with the electro-conductive rubber diaphragm 48, but in this embodiment, an electrically conductive rubber bellows 50 was used. One end of the rubber bellows 50 is fitted to the periphery of the cylindrical portion 22' of the molding 22, and the other end is fitted to the periphery of the operating rod 16. Other parts are the same as in the previous embodiments.

Since the rubber bellows has flexibility, it follows the movement of the operating rod, while keeping gas-tight. Further, since the rubber bellows is electrically conductive, it has an earthed potential, which is safe for workers or operators.

Fourth Embodiment

The fourth embodiment will be explained by reference to FIG. 8. In this embodiment, the top and bottom of the unit vacuum switch section 100 and the operating mechanism 53, 54 in the previous embodiments are reversedly arranged top and bottom thereof. According to this arrangement, connection of solid insulated bus bars 60 between the adjacent switch boards can be done remarkably easily.

Figure 6:
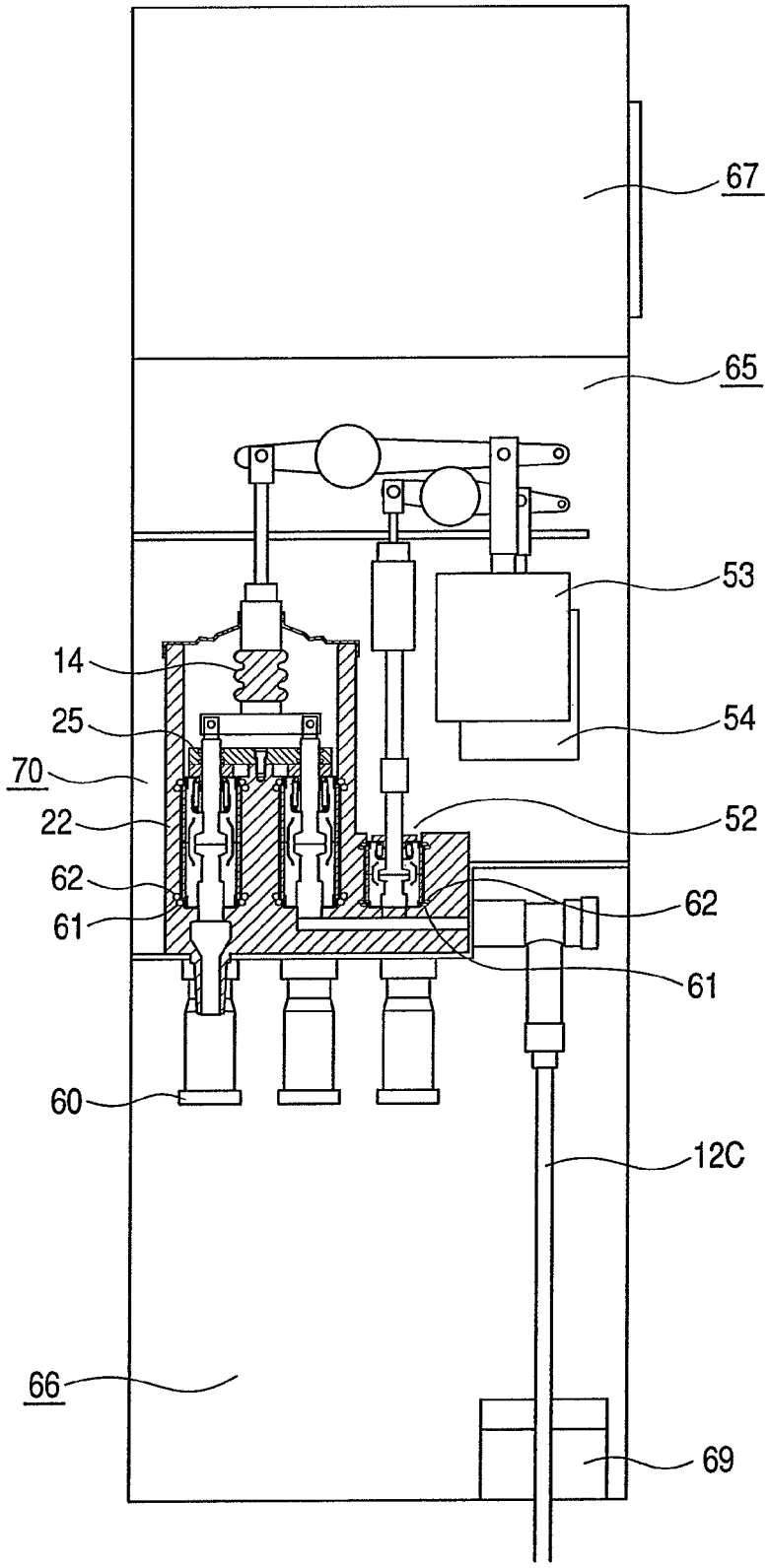
FIG. 6 is a partially cross sectional view of the switchgear that employed the unit vacuum switch of the second embodiment shown in FIG. 3.
Figure 7:
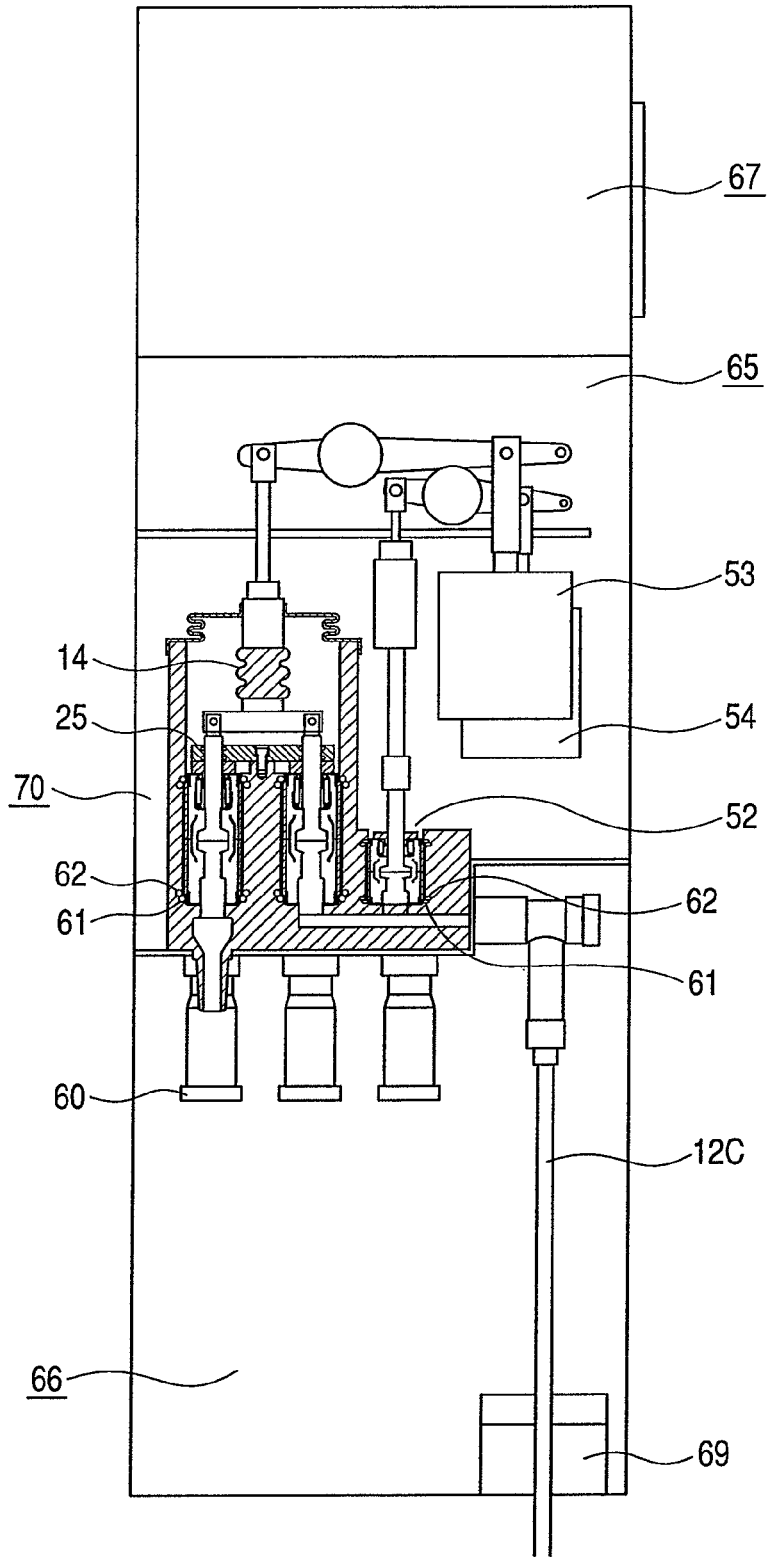
FIG. 7 is a partially cross sectional view of the switchgear that employed the unit vacuum switch of the third embodiment shown in FIG. 4.
Figure 8:
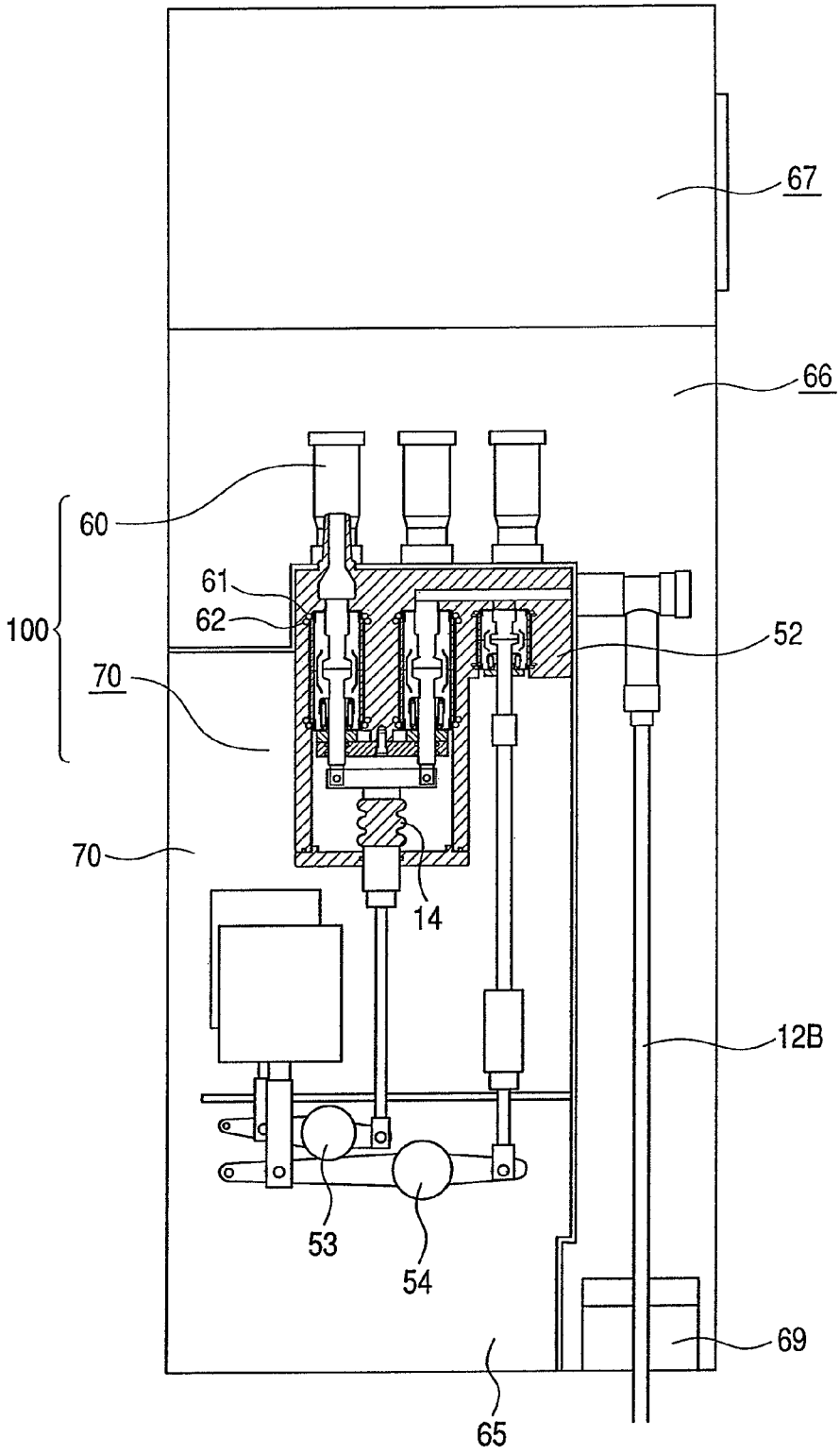
FIG. 8 is a partially cross sectional view of the switchgear that employed the unit vacuum switch of the fourth embodiment.

FIG. 8 shows only the unit vacuum switch 100 shown in the first embodiment, but the unit switch 100 shown in FIGS. 5-7 are employed for the fourth embodiment.

In the above embodiments, the unit switch 100 for each phase is molded with the molding 22, but it is possible to integrally mold the unit switches in non-segregated three phases. According to this molding, freedom of arrangement of three phases is increased so that it further contributes to downsizing of the switchgear.

What is claimed is:

1. A vacuum switch comprising a main circuit vacuum switch accommodated in a first vacuum chamber, an earth switch accommodated in a second vacuum chamber, a first operating rod connected to a movable conductor of the main circuit switch, a second operating rod connected to a movable conductor of the earth switch, and a molding case covering the first and second vacuum chambers and the first operating rod, wherein the operating rods are connectable with an operating mechanism, and the fixed conductors of the main circuit switch and earth switch are connected with bushing conductors, wherein the main circuit switch comprises two vacuum switches disposed separately in respective vacuum chambers confining separate respective vacuums, the movable of the two vacuum switches are electrically connected by means of a transition conductor, and the movable conductors are connected to a stiff transition rod, which is connected to the operating rod, and wherein the movable conductors of the two vacuum switches are operated synchronously via the transition rod.

2. The vacuum switch according to claim 1, wherein the space between the vacuum chambers of the main circuit vacuum switches is filled with the molding.

3. The vacuum switch according to claim 1, wherein the surface of the molding is covered with a conductive layer to earth the molding.

4. The vacuum switch according to claim 1, a space for accommodating the operating rod for the movable conductor of the vacuum switch is gas-tightly sealed with a molded lid having a conductive layer on the outer face thereof fitted to the molding case.

5. The vacuum switch according to claim 1, a space for accommodating the operating rod for the movable conductor of the vacuum switch is gas-tightly sealed with a flexible member one end of which is fixed to a cylinder portion of the molding case and the other is fixed to the periphery of the operating rod.

6. The vacuum switch according to claim 5, wherein the flexible member is an electro-conductive diaphragm or an electro-conductive bellows.

7. The vacuum switch according to claim 1, wherein the transition rod is fixed to the molding case.

8. A vacuum switchgear comprising the vacuum switch according to claim 1, a panel room accommodating measurement instruments, a switch unit room accommodating the vacuum switch, and a cable room accommodating bus bars.

9. The vacuum switch according to claim 1, wherein the transition conductor is provided with holes through which the movable conductors slidably penetrate into the gas insulating space.

10. The vacuum switch according to claim 1, wherein coil springs are disposed at positions where electric field concentrates.

11. The vacuum switch according to claim 1, wherein each of the vacuum chambers is constituted by an upper ceramic cylinder, a lower ceramic cylinder, an upper seal ring connected to one end of the upper ceramic cylinder, a lower seal ring connected to one end of the lower ceramic cylinder, the other ends of the upper and lower ceramic cylinders being bonded via a arc shield.

12. The vacuum switch according to claim 1, wherein the movable conductors are rigidly connected to the ends of the stiff transition rod.

13. A vacuum switchgear comprising:

a plurality of unit vacuum switches each comprising main circuit vacuum switches accommodated in a first vacuum chamber, an earth switch accommodated in a second vacuum chamber, a first operating rod connected to a movable conductor of the main circuit switch, a second operating rod connected to a movable conductor of the earth switch, and a molding case covering the first and second vacuum chambers and the first operating rod, wherein the operating rods are connectable with an operating mechanism, and the fixed conductors of the main circuit switch and earth switch are connected with bushing conductors, wherein the main circuit switch comprises two vacuum switches disposed separately in respective vacuum chambers confining separate respective vacuums, the movable conductors of the two vacuum switches are electrically connected by means of a conductive transition conductor, and the movable conductors are connected to a stiff transition rod, which is connected to the operating rod, and wherein the movable conductors of the two vacuum switches are operated synchronously via the transition rod;

a panel room accommodating measuring instruments;

an operator room accommodating an operating mechanism;

a switch unit room accommodating the unit vacuum switch; and a cable room accommodating cables for the unit vacuum switch.

14. The vacuum switchgear according to claim 13, wherein the space between the vacuum chambers of the main circuit vacuum switches is filled with the molding.

15. The vacuum switchgear according to claim 13, wherein the surface of the molding is covered with a conductive layer to earth the molding case.

16. The vacuum switch according to claim 13, wherein a space for accommodating the operating rod for the movable conductor of the vacuum switch is gas-tightly sealed with a flexible member one end of which is fixed to a cylinder portion of the molding case and the other is fixed to the periphery of the operating rod.

17. The vacuum switchgear according to claim 16, wherein the flexible member is molded lid having a conductive layer on the outer face thereof.

18. The vacuum switchgear according to claim 16, wherein the flexible member is an electro-conductive diaphragm or an electro-conductive bellows.

19. The vacuum switchgear according to claim 13, wherein the transition conductor is fixed to the molding case.

20. The vacuum switchgear according to claim 13, wherein the arrangement of the unit vacuum switch is reversed top and bottom sides.

* * * * *